US005229785A

United States Patent [19]

Leban

[11] Patent Number: 5,229,785

[45] Date of Patent: Jul. 20, 1993

[54] METHOD OF MANUFACTURE OF A THERMAL INKJET THIN FILM PRINTHEAD HAVING A PLASTIC ORIFICE PLATE

[75] Inventor: Marzio Leban, Corvallis, Oreg.

[73] Assignee: Hewlett-Packard Company, Palo Alto, Calif.

[21] Appl. No.: 610,609

[22] Filed: Nov. 8, 1990

[51] Int. Cl.[5] ..... B41J 2/05; B41J 2/16

[52] U.S. Cl. ..... 346/1.1; 346/140 R; 29/890.1; 156/644

[58] Field of Search ..... 346/140, 1.1; 156/644; 29/890.1

[56] References Cited

U.S. PATENT DOCUMENTS 4,374,707 2/1983 Pollack ..... 204/11
4,558,333 12/1985 Sugitani ..... 346/140
4,716,423 12/1987 Chan ..... 346/140
4,847,630 7/1989 Bhaskar ..... 346/1.1
4,954,225 9/1990 Bakewell ..... 204/11
5,016,024 5/1991 Lam ..... 346/1.1

*Primary Examiner*—Joseph W. Hartary

[57] ABSTRACT

A method of manufacture of a thermal inkjet printhead having a plastic orifice plate which comprises the steps of providing a dummy substrate upon which the printhead may be constructed, and then forming a plastic orifice plate member on top of the dummy substrate. Then, an insulating barrier layer is formed on the surface of the plastic orifice plate and is provided with a plurality of firing chambers therein which are aligned, respectively, with orifice openings in the plastic orifice plate. Next, a thin film resistor substrate is deposited on an exposed surface of the barrier layer and is provided with a plurality of individually defined heater resistors which are aligned, respectively, with the firing chambers in the barrier layer. Finally, the dummy substrate is removed from the composite structure using photoresist lift off techniques.

14 Claims, 7 Drawing Sheets

METHOD OF MANUFACTURE OF A THERMAL INKJET THIN FILM PRINTHEAD HAVING A PLASTIC ORIFICE PLATE

TECHNICAL FIELD

This invention relates generally to thermal inkjet (TIJ) thin film printheads useful in the manufacture of disposable thermal inkjet pens. These pens are in turn used in the operation of both monochromatic and color thermal inkjet printers. More particularly, this invention relates to the manufacture of such printheads having either all plastic orifice plates or a combination of metal and plastic orifice plates.

BACKGROUND ART

In the art and technology of inkjet printing generally, various metallic and insulating materials have been used in the fabrication of the orifice or nozzle plate of the inkjet pen which controls the ink drop ejection pattern size, geometry and drop volume of ink ejected during the operation of an inkjet pen. In the more specific field of thermal inkjet printing, this pen is frequently provided with a thin film resistor type printhead, and the orifice or nozzle plate becomes the integral and "output" layer of this printhead structure. Nickel or gold plated nickel is a metal frequently used in the manufacture of thermal inkjet printhead orifice plates, and these types of orifice plates are described, for example, in U.S. Pat. No. 4,716,423 issued to C. S. Chan et al and also in U.S. Pat. No. 4,675,083 issued to James G. Bearss et al. The use of a plastic material for an inkjet printhead orifice plate is described, for example, in U.S. Pat. No. 4,829,319 issued to C. S. Chan et al. All of the above identified patents are assigned to the present assignee and are all incorporated herein by reference.

In the manufacture of thermal inkjet printheads of the type wherein thin film resistor substrates have been employed, one common fabrication procedure has been to photolithographically define and electrically interconnect a plurality of heater resistors, such as those made of tantalum aluminum, on a thin film substrate. The base or main support member for the thin film substrate is typically glass (quartz) or silicon upon which a first silicon dioxide, $SiO_2$, passivation layer is formed and further upon which a tantalum aluminum resistive layer is deposited on the $SiO_2$ layer to serve as the resistive heater material for the inkjet printhead structure. Conductive trace material such as fine linewidth aluminum patterns are then laid down on top of the tantalum aluminum resistive layer to define the width and length dimensions of the individual heater resistors. These heater resistors are then passivated and protected by the deposition of a suitable passivation layer such as silicon nitride or silicon carbide or a combination or composite of these two dielectric materials.

Continuing the above process, it has been a common practice to construct a so-called barrier layer on top of the above $Si_3N_4$/SiC passivation and protection layer and then photolithographically define therein the firing chamber walls of the barrier layer which are normally concentrically aligned with the previously defined heater resistors. This barrier layer has been typically constructed of a material, such as polyimide or VACREL, and these ink firing chambers in the VACREL are fluidically connected to a source of ink supply and fed by one or more compartments within the main housing of the disposable inkjet pen. To complete the above pen structure, a metal orifice plate typically fabricated of gold plated nickel is then carefully aligned and secured to the exposed surface of the barrier layer so that nozzle openings in the orifice plate are aligned with respect to the center lines of the firing chambers and the centers of each individual heater resistor. This process is generally well known in the art and is described in more detail, for example, in the *Hewlett Packard Journal,* Volume 16, No. 5, May 1985, incorporated herein by reference. This type of pen body construction is also used in Hewlett Packard's well known and commercially successful ThinkJet, PaintJet, and DeskJet thermal inkjet printers.

Whereas the above type of thin film resistor printhead structure and process of manufacture have been highly regarded and widely accepted and used in the production of Hewlett Packard's disposable thermal inkjet pens, the fabrication process for making these thin film printheads is relatively expensive and is somewhat complex in both the overall number of process steps required and also in the requirement for handling and treating diverse type metal and insulating materials in the printhead manufacturing process. For example, since metal orifice plate fabrication and plating assembly lines have to be maintained separate and apart from the other thin film processing stations where the thin film resistor substrate and overlying barrier layers were processed, the required large number of individual processing steps not only had an adverse effect on achievable process yields, but they also increased significantly the overall manufacturing costs of the disposable pens in which these printheads were used.

DISCLOSURE OF INVENTION

Using a novel process combination of steps, the general purpose and principal object of this invention is to eliminate the above requirement for an all-metal orifice plate in combination with the underlying barrier layer and thin film resistor substrate. This purpose and object are accomplished by replacing the metal orifice plate of the above prior art pens with a chosen plastic orifice plate material and in accordance with a new and improved process sequence described herein. This process is useful to integrate either an all plastic orifice plate or a metal-plastic composite orifice plate structure into an otherwise standard thin film printhead construction process. A plastic orifice plate layer is economically and reliably integrated into a novel processing sequence of steps using existing thin film resistor substrate and barrier layer fabrication processes used for making state of the art thin film resistor type thermal inkjet printheads.

Another object of this invention is to provide a new and improved thermal inkjet printhead of the type described wherein some of the orifice plate-to-substrate assembly requirements for the above described all-metal orifice plate inkjet printheads in the prior art have been eliminated.

Another object of this invention is to provide a new and improved thermal inkjet printhead of the type described wherein the orifice plate-to-ink channel structure may be attached to a larger substrate consisting of a complete wafer of individual thin film resistor substrates.

Another object of this invention is to provide a new and improved thermal inkjet printhead of the type described which may be assembled at significantly lower manufacturing costs as compared to the above prior art manufacturing techniques and which is also retrofittable into and backward compatible with existing thermal inkjet pens.

A further object of this invention is to provide a new and improved thermal inkjet printhead of the type described which may be fabricated using existing state-of-the-art TIJ technology to in turn produce a TIJ printhead having an orifice plate which is not susceptible to corrosion.

A feature of this invention is the provision of a new and improved thin film printhead of the type described having a plastic orifice plate which is constructed integrally with the ink channel and firing chamber construction in the barrier layer of the printhead and using either the same or similar materials for the orifice plate and barrier layer construction. This novel processing approach eliminates the need for maintaining a separate plating shop or the like to stamp out metal orifice plates.

Another feature of this invention is the provision of a thermal inkjet printhead structure of the type described wherein, if required for certain applications, the main plastic orifice plate layer may be combined with a thin adjacent metal layer to thereby provide a composite metal-plastic orifice plate for the printhead. In this embodiment of the invention, the thin metal layer will serve as an outer protective layer for the adjacent and covered plastic orifice plate layer.

Another feature of this invention is the provision of a thin film resistor thermal inkjet printhead of the type described which may be configured either in a planar configuration, or in other configurations such as a dome-shaped configuration, either in the above all-plastic orifice plate structure or in a combination metal and plastic orifice plate structure in a total of four (4) separate embodiments of this invention.

The above objects, features and related advantages of this invention may be accomplished and achieved by the use of, among other things, an inkjet printhead manufacturing process wherein initially a dummy substrate or a reusable mandrel-type of substrate is provided and on top of which the plastic orifice plate layer is initially disposed. Orifice or nozzle openings are then photolithographically defined in the plastic orifice plate layer, and then an insulating barrier layer material, which may be of the same type of material as the orifice plate layer, is formed upon the exposed surface of the plastic orifice plate layer. Then, firing chambers and their associated ink feed channels are photolithographically defined within the insulating barrier layer and are aligned with respect to the previously formed orifice or nozzle openings in the plastic orifice plate layer. Next, a thin film resistor substrate is secured to the exposed surface of the insulating barrier layer and has a plurality of heater resistors thereon which are aligned, respectively, with a corresponding plurality of firing chambers in the insulating barrier layer and also with the individual orifice openings in the orifice plate. Lastly, the dummy substrate member which may typically consist of a combination of quartz and photoresist materials may then be removed from the thus formed thermal inkjet printhead or print engine. This may be accomplished by dissolving the photoresist layer in a suitable soak solvent etchant to thereby separate the dummy substrate from the thermal inkjet printhead formed thereon.

The above brief summary of the invention, together with its attendant objects, features and advantages, will become better understood and readily apparent from the following description of the accompanying drawings.

DETAILED DESCRIPTION OF THE DRAWINGS

Figure 1A:
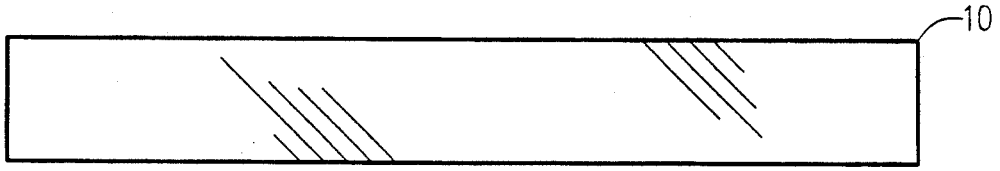
FIGS. 1A through 1H illustrate in abbreviated schematic cross-section views a sequence of processing steps which are used in the manufacture of a planar thermal inkjet printheads in accordance with a first embodiment of this invention.

Referring now to FIG. 1A, there is shown a dummy substrate or mandrel 10 which may, for example, be a silicon wafer or a glass, quartz, or ceramic substrate of any desired shape such as circular, square, rectangular, etc. The dummy substrate 10 is used as a temporary mandrel on which the plastic orifice plate to be described and the ink channel therein are constructed. Advantageously, and for purposes of this description, a round quartz wafer is selected for the dummy substrate 10 and it has the advantage of being transparent to both ultraviolet and visible light.

Figure 1B:
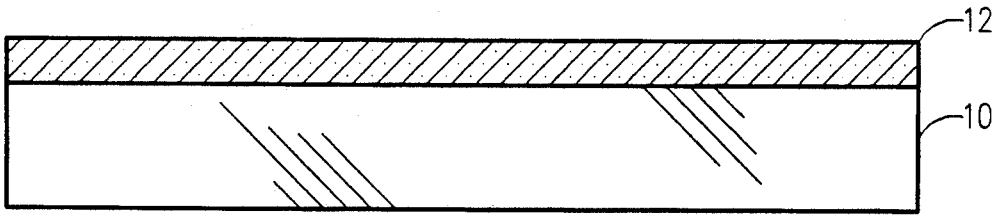

As shown in FIG. 1B, the quartz dummy substrate 10 is coated with a material 12 which must satisfy several requirements. It must be flat and be capable of development with a chemistry which is incompatible with that used for etching any of the other subsequently coated materials. That is, solvents or a mix of solvents which will eventually be used to remove a portion of the coated material 12 must not interact chemically or physically with materials which will be subsequently applied and used in later steps of the process. Therefore, in a presently preferred embodiment of this invention, a photoresist polymer has been chosen for the material 12, and photoresist is curable so that it can be easily removed with a suitable solvent system at a later step in the process described below.

Figure 1C:
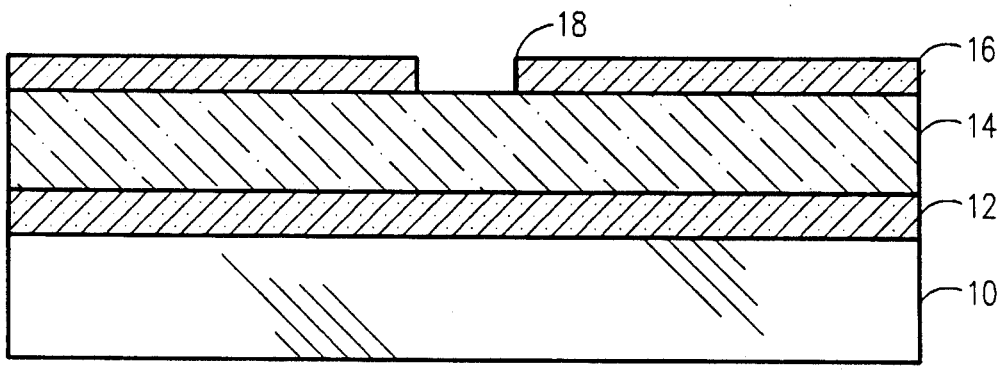

Referring now to FIG. 1C, the photoresist layer 12 is now coated with a suitable plastic material 14, and this coating step may be achieved by either spinning, spraying, or laminating the plastic material 14 on top of the photoresist layer 12 depending upon the material choice and the desired material thickness. The plastic material 14 may or may not be photodefinable: however, the subsequent processing will be simplified if the plastic layer 14 is photodefinable. Therefore, in a preferred embodiment of this invention, the VACREL polymer mixture has been selected for the plastic material 14 since VACREL is photodefinable and can be laminated on the photoresist layer 12 in dry form. In addition, the VACREL layer 14 may be subsequently treated with selective etchants which do not adversely interact with the underlying photoresist layer 12.

Figure 1D:
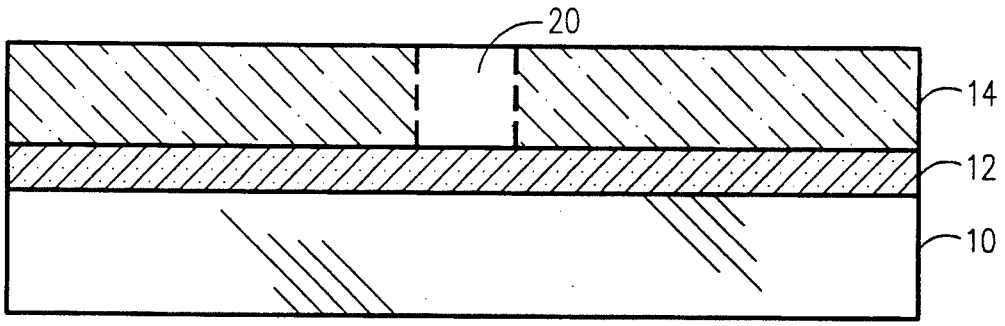

After the plastic orifice plate layer 14 has been deposited on the upper surface of the photoresist layer 12, an etch mask 16 such as photoresist is formed as shown on the upper surface of the VACREL layer 14 and is photolithographically defined so as to have an opening 18 therein. The photoresist etch mask 16 is therefore used to define the orifice opening 20 as shown in FIG. 1D. For this step, a plastic or VACREL etchant such as an aqueous solution of sodium carbonate ($Na_2CO_3$) may be used to remove the plastic material from the region 20 of the layer 14 and to define the orifice opening 20 as indicated in FIG. 1D. This etchant will stop and cease its etching function when reaching the underlying photoresist layer 12 previously described.

Figure 1E:
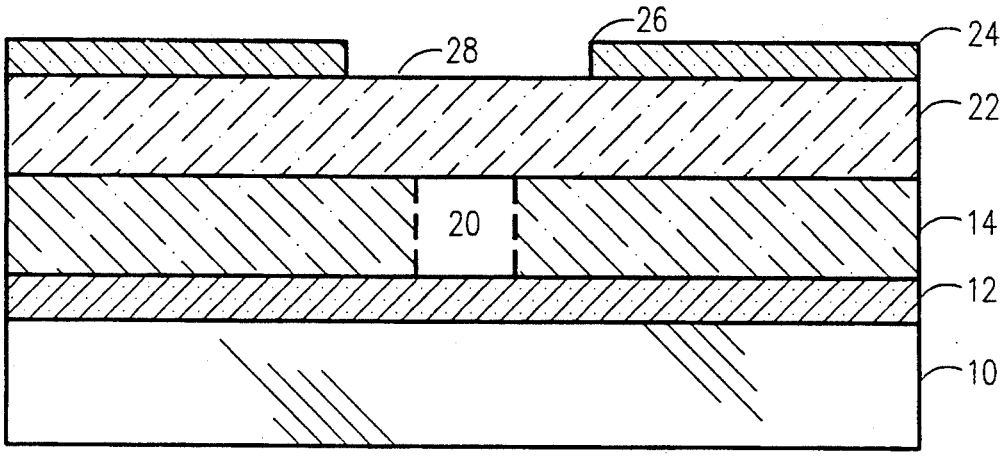

After the orifice opening 20 in FIG. 1D has been suitably formed, the substructure shown therein is transferred to a barrier layer deposition station where an insulating barrier layer 22 is formed on top of the plastic orifice plate layer 14. In a preferred embodiment of the invention, the insulating barrier layer 22 will also be a plastic material, such as VACREL, which can be sprayed or laminated on the upper surface of the plastic orifice plate 14 and, like the orifice plate material 14, may be photodefinable by the use of a photoresist mask or the like. In a preferred embodiment of the invention, the polymer material 22 has also been specifically selected as VACREL, since this polymer material can be laminated in dry film form and can also be selectively etched by the use of another photoresist mask 24 having an opening 26 therein as shown in FIG. 1E. A suitable etchant such as an aqueous solution of sodium carbonate ($Na_2CO_3$) may be used to remove a portion 28 of the VACREL layer 22 so as to define an ink feed channel and firing chamber geometry 32 indicated in FIG. 1F. The sidewalls 30 of the VACREL barrier layer 22 in FIG. 1F define the boundaries of a firing chamber 32 therein which is normally concentrically aligned with the previously formed orifice opening 20 in the plastic orifice plate 14. The firing chamber 32 may be interconnected through a photodefined ink passage (not shown) useful to fluidically couple the ink firing chamber 32 to a remote source of ink supply in a well known manner.

Figure 1F:
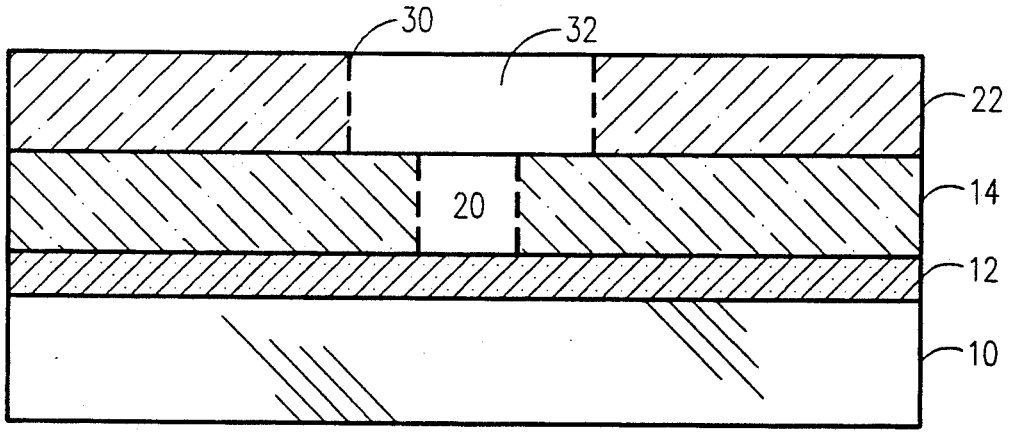
Figure 1G:
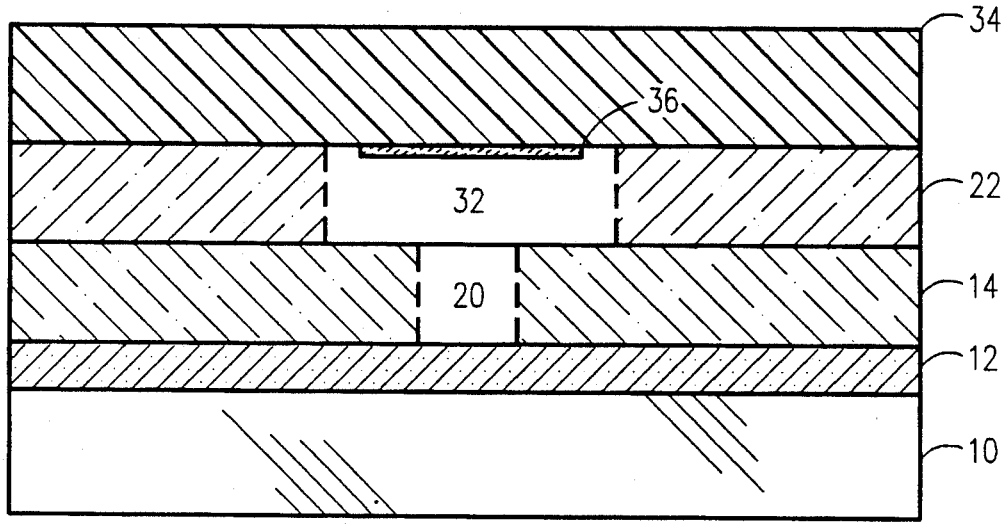

After the firing chamber 32 and associated ink feed passages (not shown) in the VACREL insulating barrier layer 22 have been developed, and after the subsequent removal of the photoresist layer 24 as shown in FIG. 1E, the substructure shown in FIG. 1F is then transferred to a thin film resistor substrate deposition station where a thin film heater resistor type substrate 34 is precisely aligned with and secured to the VACREL barrier layer 22. In this step, one or more heater resistors 36 which have been previously formed using known heater resistor definition techniques are precisely aligned with both the firing chambers 32 and the orifice plate openings 20 as previously described. The thin film resistor substrate 34 may be of the type disclosed, for example, in the above identified *Hewlett Packard Journal*, Volume 16, No. 5, May 1985, and the heater resistor element 36 in FIG. 1G is intended to be a schematic representation of a large plurality of photodefined individual heater resistors which may be create on tantalum aluminum resistive layers on which aluminum conductive trace material has been patterned. This conductive trace material defines the length and width dimensions of these heater resistors and serves as electrical conductors (not shown) for providing drive current pulses to the heater resistors represented by the heater element 36 in FIG. 1G. As will understood and appreciated by those skilled in the art, the heater resistor element 36, the firing chamber 32 and the orifice plate opening 20 as shown in FIG. 1G represent a large plurality of these elements 36, 32, and 20 constructed in a thermal ink jet printhead and fabricated in accordance with the teachings of the present invention.

Figure 1H:
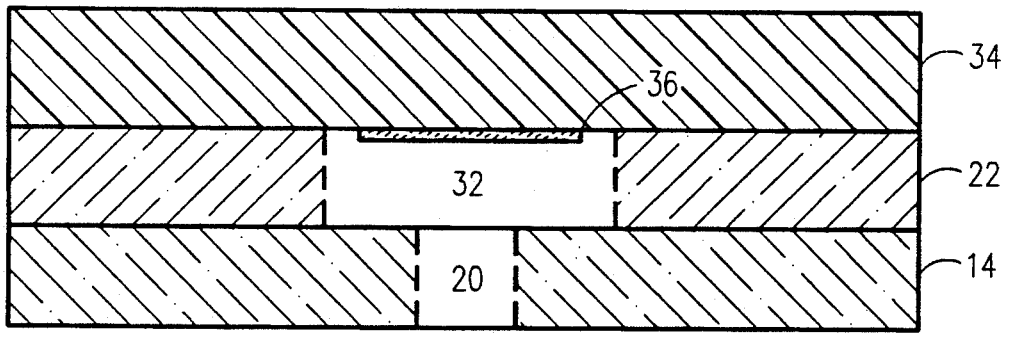

After the structure shown in FIG. 1G has been completed, it is transferred to a suitable photoresist removal station wherein a suitable soak solvent etchant is utilized to remove the photoresist layer 12 from the downwardly facing surface of the plastic orifice plate 14. This step is used to remove the dummy substrate or mandrel member 10 from the composite structure shown in FIG. 1G, thereby leaving intact the print engine shown in FIG. 1H and now ready for mounting, such as by die bonding, on an appropriate ink feed surface of a disposable inkjet pen (not shown) or the like. These disposable inkjet pens are available in both multi-color and black inks and are disclosed in some detail, for example, in U.S. Pat. No. 4,771,295 issued to Baker et al and in U.S. Pat. No. 4,500,895 issued to Buck et al, both assigned to the present assignee and incorporated herein by reference.

Figure 2A:
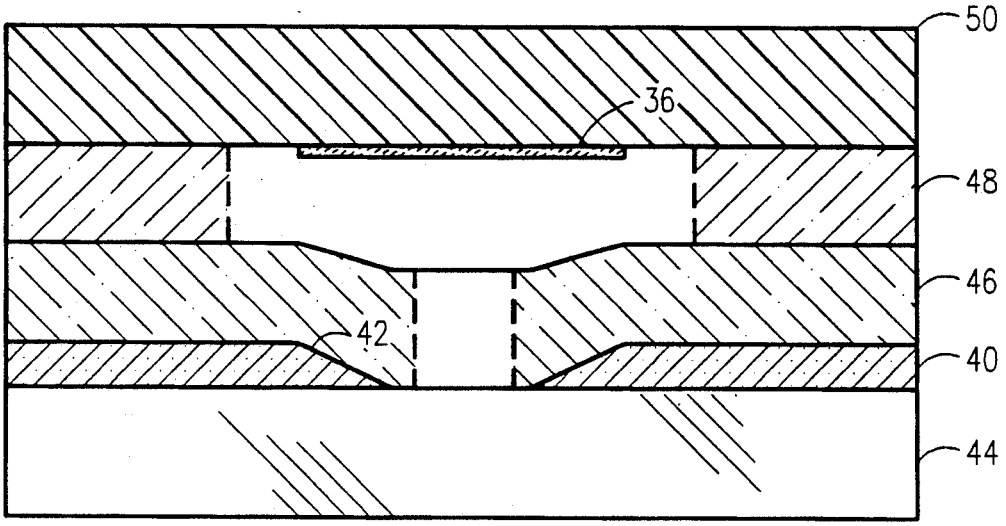
FIGS. 2A and 2B illustrate in abbreviated schematic cross-section views a sequence of processing steps used in the manufacture of a dome-shaped thermal inkjet printhead fabricated in accordance with a second embodiment of this invention.
Figure 2B:
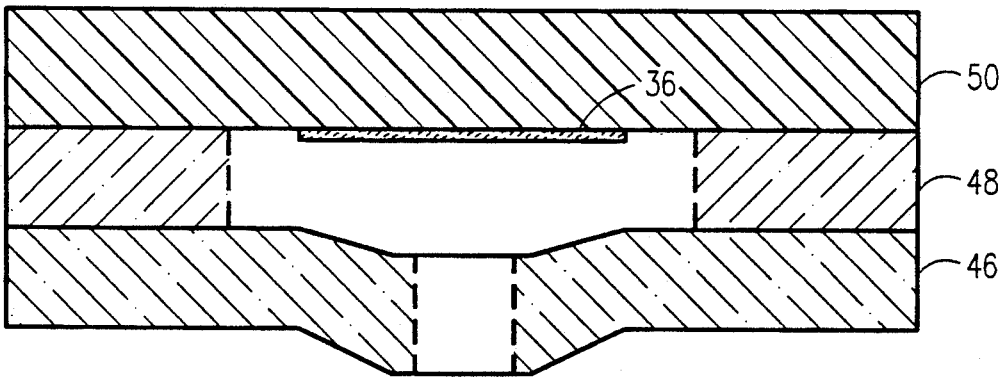

Referring now to FIGS. 2A and 2B, these schematic cross-section views are used to illustrate the formation of a dome-shaped plastic orifice plate for the print engine. This dome-shaped structure is achieved by providing a photoresist layer 40 as shown in FIG. 2A and by beveling the edges 42 thereon so as to provide the angled photoresist edges 42 which taper as shown in a predetermined contact angle down into contact with the upper surface of the underlying dummy substrate 44. Using this technique, the plastic orifice plate layer 46 can now be laminated, sprayed or spun on the upper surface of the photoresist layer 40 and will in turn replicate the contour of the photoresist layer 40 to provide the dome-shaped geometry of the plastic orifice plate member 46 as shown in FIG. 2A.

An insulating barrier layer 48 and a thin film resistor printhead substrate 50 are then successively applied to build up the composite print engine structure shown in FIG. 2A and using processes identical to those described above in the processing steps of FIGS. 1A through 1H. Upon completion of the composite dome-shape structure shown in FIG. 2A, this structure is transferred to a suitable photoresist removal solvent station where the composite structure in FIG. 2A will immersed in a suitable soak solvent etchant which is operative to remove the photoresist layer 40 as shown in FIG. 2A, carrying with it the underlying dummy substrate or mandrel 44 and leaving intact the dome-shaped print engine as shown in FIG. 2B.

Figure 3A:
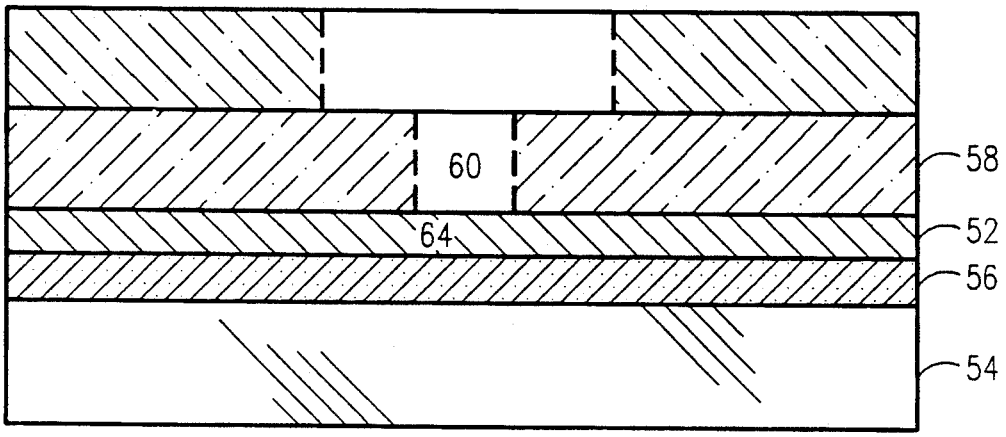
FIGS. 3A through 3C illustrate in abbreviated schematic cross-section views a sequence of processing steps used in the manufacture of another planar thermal inkjet printhead according to a third embodiment of the invention. In this embodiment, the orifice plate is fabricated with a composite layer combination of certain chosen metal and plastic materials.
Figure 3B:
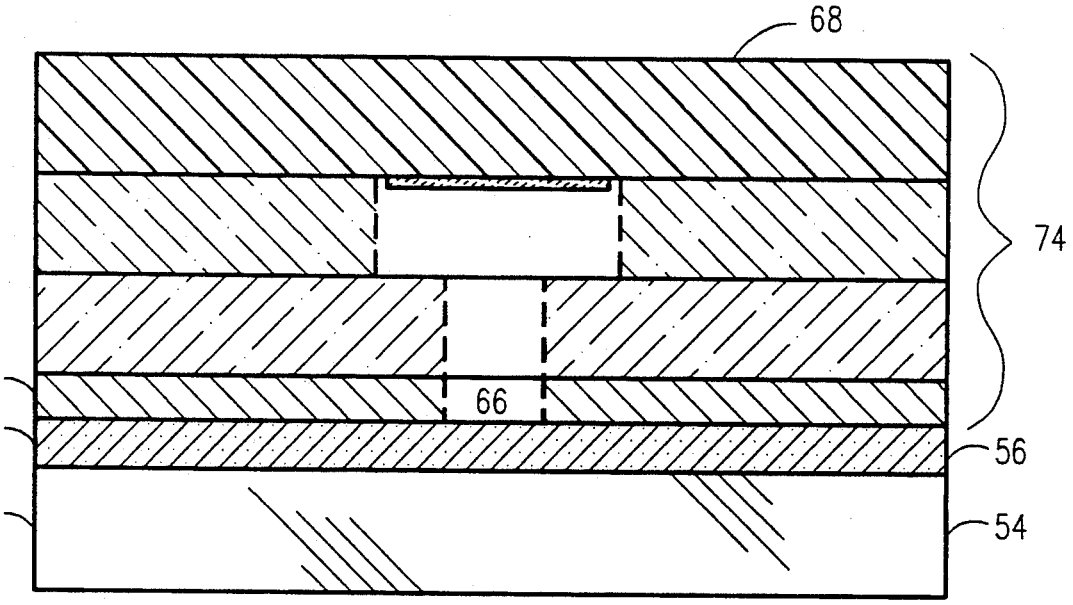
Figure 3C:
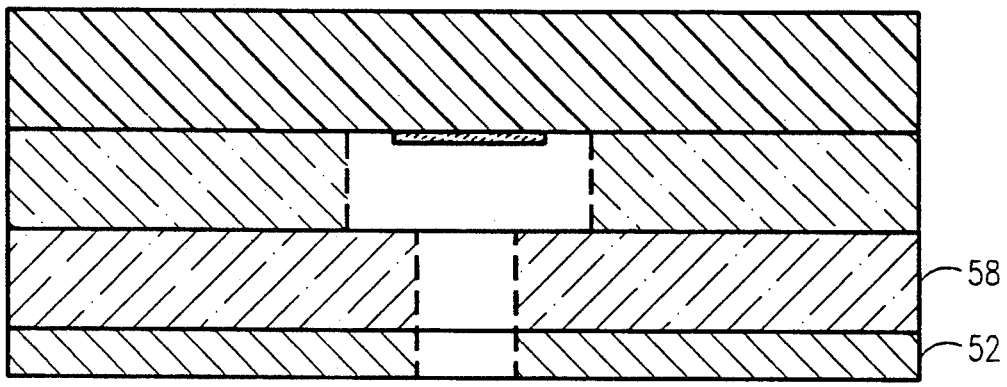

Referring now to FIG. 3A, there is shown the composite metal-plastic orifice plate embodiment of the invention wherein a suitable metal film 52, such as tantalum, platinum, gold, nickel, or the like is deposited on top of a photoresist layer 56 prior to the deposition of the plastic orifice plate layer 58 thereon in a manner similar to that described above with reference to the plastic orifice plate 14. Thus, in the planar composite metal-plastic orifice plate embodiment of the invention shown in FIG. 3A, the inkjet orifice plate will now consist of a composite structure of the plastic layer 58 and the thin metal layer 52. The plastic layer 58 is etched as described above to first form an orifice opening 60 therein so that with the orifice opening 60 thus formed, the plastic layer 58 may now serve as an etch mask for the removal of the metal material in the region 64 of the thin metal layer 52, thereby leaving an orifice opening 66 in the metal layer as indicated in FIG. 3B and precisely aligned with the plastic orifice opening 60. The structure of FIG. 3A is then transferred to a thin film resistor substrate attachment station wherein the thin film resistor substrate 68 is attached to and aligned with the insulating barrier layer 70 as indicated in FIG. 3B and in the manner described above with respect to the earlier thin film resistor substrate attachment and alignment procedures. Then, the structure of FIG. 3B is transferred to a photoresist removal solvent station wherein the dummy substrate 54 and the photoresist layer 56 are removed from contact with the thin metal orifice layer 52. This step leaves intact the print engine indicated by the bracket 74 in FIG. 3B which is shown separated from the dummy substrate and photoresist layer 54 and 56 in FIG. 3C.

Figure 4:
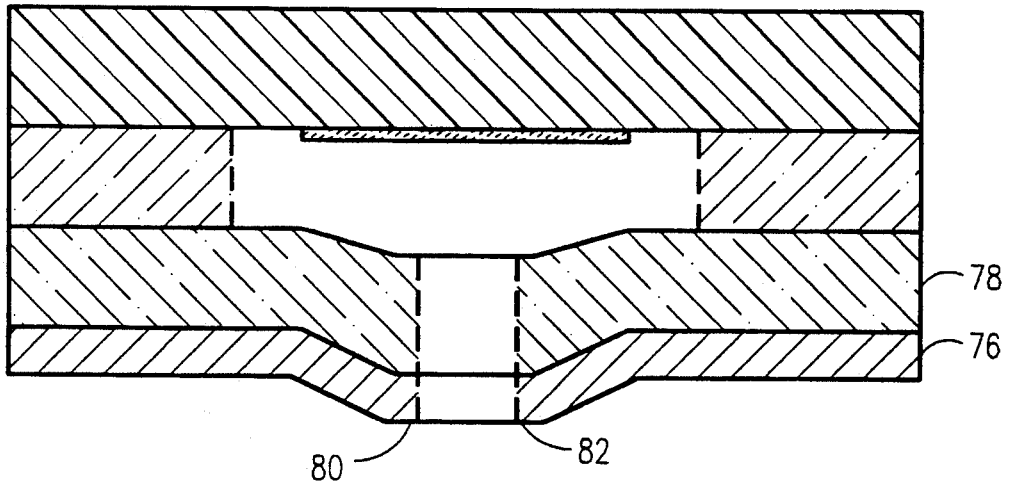
FIG. 4 is a schematic cross section view of the dome shaped alternative embodiment of the invention and corresponds, materials wise, to the materials used in constructing the planar inkjet printhead structure shown in the schematic cross section view of FIG. 3C.

Referring now to FIG. 4, the dome-shaped structure therein and particularly the dome-shaped orifice plate consisting of the thin metal layer 76 and the adjacent plastic orifice plate layer 78 may be processed in a manner described above with respect to the dome-shaped embodiments of FIGS. 2A and 2B. In this printhead structure in FIG. 4, the dome contour 80 in the thin metal layer 76 and the dome surface 82 thereof will be the surface closest to the print media during a thermal inkjet printing operation. Such a dome shaped orifice plate construction may be desirable in applications which require that increased printhead printing speeds be achieved, and this increase in printhead speed may be achieved by reducing the total orifice plate area 82 which is most closely adjacent to the print media.

Various modifications and alterations may be made in the above described embodiments without departing from the spirit and scope of the invention. For example, various other metal, plastic, and polymer materials other than those specifically described above may be used in the above described embodiments and in accordance with certain particular print engine applications. In addition, the process steps described above may be carried out over large surface areas and in the simultaneous fabrication of large numbers of thin film resistor type thermal inkjet printheads and in shapes and geometries other than the specific planar and dome-shaped configurations described above. Accordingly, it will be understood by those skilled in the art that these and other process and design modifications are clearly within the scope of the following appended claims.

I claim:

1. A process for fabricating a thin film printhead useful in the construction of disposable thermal inkjet pens and comprising the steps of:

a. providing a dummy substrate or mandrel member upon which said printhead may be constructed, b. depositing a plastic orifice plate member on top of said dummy substrate or mandrel member and providing said orifice plate with a plurality of orifice openings therein, c. depositing a barrier insulating layer on said plastic orifice plate and providing therein a plurality of firing chambers aligned, respectively, with said orifice openings in said plastic orifice plate member, d. depositing a previously and separately fabricated thin film resistor substrate on an exposed surface of said barrier layer and provided with a plurality of individually defined heater resistors thereon aligned, respectively, with said firing chambers in said barrier layer and adapted to receive electrical drive pulses for propelling ink within said firing chambers through the adjacent orifice openings in said orifice plate, and e. removing said dummy substrate or mandrel member from said plastic orifice plate, whereby the thin film resistor substrate is not exposed to temperature cycling associated with orifice plate manufacture.

2. The process defined in claim 1 wherein said dummy substrate or mandrel member is constructed of a base material upon which a layer of photoresist has been deposited for receiving said plastic orifice plate member thereon and subsequently being removable from said orifice plate member by the use of a soak solvent etchant or the like.

3. The process defined in claim 1 wherein said plastic orifice plate member is formed by initially depositing a thin continuous layer of a preselected plastic material above the surface of said dummy substrate and thereafter photodefining and etching a plurality of orifice openings in said plastic orifice plate member.

4. The process defined in claim 1 wherein the formation of said barrier layer on said plastic orifice plate member includes initially depositing a preselected insulating barrier layer material, such as a polyimide or VACREL material, on an exposed surface of said orifice plate member, and thereafter photodefining and etching firing chambers and associated ink feed channels in said barrier layer for thereby providing a path of ink flow from an exterior ink supply into said plurality of firing chambers.

5. The process defined in claim 1 wherein said thin film resistor substrate is fabricated by providing a plurality of individually defined heater resistors of a preselected resistive material on said thin film resistor substrate and aligned, respectively, with each of said previously photodefined firing chambers and orifice openings in said barrier layer and plastic orifice plate member, respectively.

6. The process defined in claim 2 wherein said plastic orifice plate member is formed by initially depositing a thin continuous layer of a preselected plastic material above the surface of said dummy substrate and thereafter photodefining and etching a plurality of orifice openings in said plastic orifice plate member.

7. The process defined in claim 6 wherein the formation of said barrier layer on said plastic orifice plate member includes initially depositing a preselected insulating barrier layer material, such as a polyimide or a mixture of polymer materials, on an exposed surface of said orifice plate member, and thereafter photodefining and etching firing chambers and associated ink feed channels in said barrier layer for thereby providing a path of ink flow from an exterior ink supply into said firing chambers.

8. The process defined in claim 7 wherein said thin film resistor substrate is fabricated by providing a plurality of individually defined heater resistors of a preselected resistive material on said thin film resistor substrate and aligned, respectively, with each of said previously photodefined firing chambers and orifice openings in said barrier layer and plastic orifice plate member, respectively.

9. The process defined in claim 8 which further includes forming a thin metal orifice plate layer adjacent to said plastic orifice plate layer to thereby form a composite metal-plastic orifice plate layer for said printhead.

10. A process for fabricating an inkjet printhead which comprises the steps of:

a. forming a plastic orifice plate atop a dummy substrate, b. depositing a barrier layer and a previously and separately fabricated thin film resistor substrate in succession atop said plastic orifice plate, and c. removing said dummy substrate from said plastic orifice plate.

11. The process defined in claim 10 which further includes the steps of securing a thin metal orifice plate layer to said plastic orifice plate layer, whereby said metal orifice plate layer may be formed between said dummy substrate and said plastic orifice plate layer.

12. The process defined in claim 10 wherein said plastic orifice plate is constructed in either a planar configuration or a dome-shaped configuration.

13. The process defined in claim 11 wherein said plastic orifice plate and thin metal orifice plate layer thereon are constructed in either a planar configuration or a dome-shaped configuration.

14. An inkjet printhead manufactured by the process of:

a. forming a plastic orifice plate atop a dummy substrate, b. depositing a barrier layer and a previously and separately fabricated thin film resistor substrate in succession atop said plastic orifice plate, and c. removing said dummy substrate from said plastic orifice plate.

* * * * *